US012637183B2

(12) United States Patent
Garver et al.

(10) Patent No.: US 12,637,183 B2
(45) Date of Patent: May 26, 2026

(54) WATERBORNE WASTE-DISPOSAL VESSEL

(71) Applicant: The Buffalo Bayou Partnership, Houston, TX (US)

(72) Inventors: Curtis Michael Garver, Houston, TX (US); John Arthur Robinson, III, Marble Falls, TX (US)

(73) Assignee: The Buffalo Bayou Partnership, Houston, TX (US)

( * ) Notice: Subject to any disclaimer, the term of this patent is extended or adjusted under 35 U.S.C. 154(b) by 388 days.

(21) Appl. No.: 18/482,120

(22) Filed: Oct. 6, 2023

(65) Prior Publication Data

US 2025/0115337 A1 Apr. 10, 2025

(51) Int. Cl.

| | |
|---|---|
| ***B63B 35/32*** | (2006.01) |
| ***B63B 35/00*** | (2020.01) |
| ***B63H 5/125*** | (2006.01) |

(52) U.S. Cl.

CPC ..... *B63B 35/32* (2013.01); *B63H 5/125* (2013.01); *B63B 2035/001* (2013.01)

(58) Field of Classification Search

None

See application file for complete search history.

(56) References Cited

U.S. PATENT DOCUMENTS 76,387 A * 4/1868 Bell ..... A01K 73/06 43/8
478,579 A * 7/1892 Dunham ..... A01K 73/06 43/8
763,327 A * 6/1904 Roche ..... B01D 35/05 210/242.1
1,138,541 A * 5/1915 Conekin ..... A01K 75/02 123/73 D
1,151,856 A * 8/1915 Bayless ..... E01H 1/0854 15/348
1,168,175 A * 1/1916 Deardorff ..... A47L 7/0038 15/388
1,304,302 A * 5/1919 Gage ..... A01K 73/06 43/8
1,486,485 A * 3/1924 Frissell ..... A01K 80/00 43/6.5

(Continued)

OTHER PUBLICATIONS https://www.mrtrashwheel.com/, "Mr. Trash Wheel A Proven Solution to Ocean Plastics", accessed Oct. 3, 2023.

(Continued)

*Primary Examiner* — Robert J Popovics
(74) *Attorney, Agent, or Firm* — Baker Botts L.L.P.

(57) ABSTRACT

A waterborne vessel includes a removable container having two or more wheels, one or more guiderails substantially beneath the removable container, a vacuum having a fan, and at least one winch coupled to the container via one or more of a rope, a cable, and a chain. The removable container is disposed upon a top surface of a body of the waterborne vessel. The one or more guiderails are operable to direct a movement of the two or more wheels of the removable container. The at least one winch is operable to pull the container generally along the one or more guiderails. Actuation of the fan causes one or more objects to be drawn substantially upward into the vacuum. The one or more objects are delivered to the removable container.

7 Claims, 5 Drawing Sheets

(56) References Cited

U.S. PATENT DOCUMENTS 1,489,917 A * 4/1924 Blecker ..... A01K 74/00 43/17.5
1,490,428 A * 4/1924 Paris ..... A01K 74/00 43/8
1,557,747 A * 10/1925 Wagner ..... E01H 1/0845 15/374
2,064,408 A * 12/1936 Blecker ..... A01K 74/00 43/6.5
2,406,236 A * 8/1946 Mcdougall ..... B63B 35/54 114/70
2,413,552 A * 12/1946 Ethridge ..... A01K 74/00 43/103
2,496,028 A * 1/1950 Wells ..... E01H 1/0836 15/340.1
2,649,965 A * 8/1953 King ..... B62B 3/008 210/241
2,663,894 A * 12/1953 Elliotte ..... E01H 1/0836 15/340.1
2,853,968 A * 9/1958 Mclean ..... B63B 25/28 114/72
2,890,543 A * 6/1959 Mitchell ..... A01K 73/02 43/9.1
2,948,980 A * 8/1960 Worcester ..... A01K 80/00 43/9.1
3,142,281 A * 7/1964 Muller ..... E02B 15/046 210/923
3,193,867 A * 7/1965 Daneman ..... E01H 1/0836 239/592
3,219,190 A * 11/1965 Fridtjof ..... E02B 15/046 210/523
3,268,081 A * 8/1966 Menkee ..... E02B 15/046 210/523
3,270,706 A * 9/1966 Muller ..... B63B 35/32 114/264
3,280,777 A * 10/1966 Matzer ..... B63B 19/08 114/260
3,326,379 A * 6/1967 Caddick ..... B63B 35/32 210/523
3,348,690 A * 10/1967 Cornelissen ..... E02B 15/047 210/523
3,434,444 A * 3/1969 Caddick ..... E02B 15/046 114/57
3,460,186 A * 8/1969 Barnette ..... E01H 1/0836 15/340.1
3,539,048 A * 11/1970 Pearson ..... E02B 15/046 210/242.3
3,541,631 A * 11/1970 Kluge ..... E01H 1/0836 55/342
3,563,380 A * 2/1971 Thomas ..... E02B 15/06 210/776
3,637,080 A * 1/1972 Markel ..... E02B 15/104 210/776
3,666,312 A * 5/1972 Harris ..... B60P 1/04 134/115 R
3,700,108 A * 10/1972 Richards ..... E02B 15/08 210/923
3,730,119 A * 5/1973 Budris ..... B63B 35/32 210/242.3
3,731,813 A * 5/1973 Tipton ..... E02B 15/046 210/776
3,762,558 A * 10/1973 Anderson ..... B63B 35/32 210/776
3,767,055 A * 10/1973 Flatland ..... E02B 15/048 210/167.2
3,786,592 A * 1/1974 Miller ..... A01K 74/00 43/6.5
3,804,177 A * 4/1974 Renfroe ..... E02F 5/285 210/776
3,891,558 A * 6/1975 Condit, Jr. ..... E02B 15/104 210/526
3,926,812 A * 12/1975 Neal ..... B63B 35/32 210/776
3,928,206 A * 12/1975 Waren ..... E02B 15/046 210/776
3,995,754 A * 12/1976 DeKoning ..... B65F 3/0209 15/340.1
4,006,086 A * 2/1977 Tsunoi ..... E02B 15/108 210/776
4,017,281 A * 4/1977 Johnstone ..... B01D 46/04 15/352
4,053,412 A * 10/1977 Stix ..... E04H 4/1263 210/167.2
4,060,487 A * 11/1977 Samsel ..... E02B 15/046 210/923
4,086,717 A * 5/1978 Aucoin, Jr. ..... A01K 74/00 43/6.5
4,128,068 A * 12/1978 Ogura ..... B63B 35/32 210/242.3
4,135,468 A * 1/1979 Kirby ..... B63B 35/42 114/260
4,141,308 A * 2/1979 Gainey ..... E02B 15/10 440/37
4,258,534 A * 3/1981 Bryant ..... A01D 44/00 56/9
4,264,444 A * 4/1981 Bronnec ..... E02B 15/046 210/923
4,305,830 A * 12/1981 Shimura ..... E02B 15/108 210/801
4,322,294 A * 3/1982 Price ..... E02B 15/104 210/540
4,336,137 A * 6/1982 Byers ..... B63J 4/00 210/923
4,363,735 A * 12/1982 Hook ..... E02B 15/00 210/776
4,509,286 A * 4/1985 John ..... A01K 73/00 43/9.1
4,518,495 A * 5/1985 Harding ..... E04H 4/1609 D23/209
4,578,840 A * 4/1986 Pausch ..... E01H 1/0836 15/340.1
4,663,879 A * 5/1987 Bergeron, Jr. ..... A01K 80/00 43/4.5
4,674,984 A * 6/1987 Caddick ..... B63B 35/32 165/44
4,889,622 A * 12/1989 Newcombe-Bond ..... E04H 4/1263 134/167 R
4,900,432 A * 2/1990 Arnold ..... E04H 4/1263 210/91
4,921,605 A * 5/1990 Chastan-Bagnis .... E02B 15/046 210/135
4,929,350 A * 5/1990 Wade ..... A01K 79/00 210/242.1
4,963,172 A * 10/1990 DeMarco ..... B01D 46/00 55/459.1
5,028,325 A * 7/1991 Hamilton ..... B63B 35/32 210/242.1
5,048,222 A * 9/1991 Correll ..... A01K 80/00 43/104
5,106,492 A * 4/1992 Distinti ..... E04H 4/1263 210/167.2
5,128,031 A * 7/1992 Midkiff ..... B01D 35/05 210/167.2
5,148,758 A * 9/1992 Saly ..... B09B 1/002 110/220
5,173,182 A * 12/1992 Debellian ..... E02B 15/046 114/61.1
5,207,901 A * 5/1993 Ravagnan ..... B63B 35/32 405/60
5,217,611 A * 6/1993 Ayroldi ..... E02B 15/047 210/242.1
5,404,696 A * 4/1995 Vasby ..... A01D 44/00 56/8
5,456,197 A * 10/1995 Kwok ..... E02B 15/046 114/382
5,457,908 A * 10/1995 Sanders ..... A01K 71/00 56/9

(56) References Cited

U.S. PATENT DOCUMENTS 5,566,492 A * 10/1996 Swenson ..... A01K 61/59 43/6.5
5,596,788 A * 1/1997 Linville ..... E01H 1/0827 15/340.1
5,649,573 A * 7/1997 Crum ..... A01C 23/045 414/467
5,839,216 A * 11/1998 Baker ..... A01K 79/00 43/6.5
5,863,440 A * 1/1999 Rink ..... C02F 1/681 210/923
5,893,978 A * 4/1999 Yoda ..... C02F 7/00 405/63
6,143,172 A * 11/2000 Rink ..... B01D 17/0205 210/241
6,328,165 B1 * 12/2001 Baker ..... A01K 79/00 43/4.5
6,389,641 B1 * 5/2002 Boomgaarden ..... E01H 1/0836 15/340.1
6,519,892 B1 * 2/2003 Jaime ..... A01K 74/00 43/6.5
6,669,841 B2 * 12/2003 Morin ..... B63B 35/32 210/242.1
6,832,465 B2 * 12/2004 Horvath ..... A01B 35/00 56/9
6,942,717 B2 * 9/2005 Armstrong ..... B01D 46/04 55/432
7,045,058 B2 * 5/2006 Walczyk ..... E02B 15/048 210/242.1
7,101,475 B1 * 9/2006 Maaske ..... E04H 4/1263 210/167.2
7,341,012 B2 * 3/2008 Loke ..... B63B 35/28 114/31
7,452,462 B2 * 11/2008 Joliet ..... B63B 35/32 210/923
7,485,235 B2 * 2/2009 Kellett ..... B63B 35/32 210/776
7,504,025 B2 * 3/2009 Burgassi ..... E04H 4/1654 210/167.2
7,958,705 B1 * 6/2011 Bourque ..... A01D 44/00 56/8
8,097,152 B2 * 1/2012 Lewis ..... B63B 35/32 210/175
8,881,341 B2 * 11/2014 Schmidt, Jr. ..... E03F 9/00 15/340.1
9,150,286 B2 * 10/2015 Siewert ..... B63B 35/32
9,290,242 B2 * 3/2016 Kang ..... B03C 7/006
9,334,617 B2 * 5/2016 Caraballo Benitez .. B63B 35/32
9,493,215 B2 * 11/2016 Horton ..... E02B 15/104
9,556,577 B2 * 1/2017 Vaz Viegas ..... E02B 15/048
9,556,578 B1 * 1/2017 LaMora, Jr. ..... E04G 21/3204
9,903,083 B2 * 2/2018 Lindholm ..... B63B 35/32
9,976,271 B2 * 5/2018 Casadio ..... E04H 4/1654
10,046,983 B2 * 8/2018 De Luca ..... E02B 15/08
10,323,375 B1 * 6/2019 Bates, Jr. ..... E02B 15/0835
10,323,376 B1 * 6/2019 Nickelson ..... E02B 15/106
10,370,068 B2 * 8/2019 Dieters ..... B63B 35/32
10,519,616 B2 * 12/2019 Casadio ..... E02B 15/104
10,676,164 B2 * 6/2020 Carlési ..... B63B 35/32
10,683,627 B2 * 6/2020 Covington ..... E02B 15/0864
10,689,821 B1 * 6/2020 Whittington ..... B63B 35/32
10,870,962 B1 * 12/2020 Nickelson ..... E02B 15/106
10,900,187 B1 * 1/2021 Gadh ..... E02B 15/048
11,001,351 B1 * 5/2021 Aguilera ..... E02B 15/046
11,001,352 B1 * 5/2021 Nassim ..... E02B 15/104
11,091,891 B1 * 8/2021 Kelly ..... E02B 15/10
11,097,815 B2 * 8/2021 Hernández ..... B63B 35/32
11,247,926 B2 * 2/2022 Edgell, II ..... B01D 29/6469
11,254,397 B1 * 2/2022 Calvert ..... F27B 14/12
11,371,201 B1 * 6/2022 Covington ..... E02B 15/048
11,396,731 B2 * 7/2022 Ji ..... E02B 15/0807
11,414,824 B2 * 8/2022 Bryzek ..... E02B 15/045
11,453,989 B2 * 9/2022 Negron ..... E02B 15/10
11,470,830 B1 * 10/2022 Bosteels ..... A01K 73/00
11,472,517 B2 * 10/2022 Lin ..... B63B 1/121
11,613,862 B2 * 3/2023 Cui ..... B01D 33/155 210/170.09
11,629,471 B2 * 4/2023 Marshall ..... E02B 15/104 210/747.6
11,649,021 B2 * 5/2023 Spencer ..... G07C 5/008 701/21
11,661,156 B2 * 5/2023 Svorcan ..... B63H 1/12 210/747.6
11,772,753 B2 * 10/2023 Dakhil ..... B63H 1/36 114/61.27
11,840,321 B2 * 12/2023 Lordi ..... B63B 35/32
12,077,257 B2 * 9/2024 Maydanik ..... B07B 1/005
12,077,258 B2 * 9/2024 Na ..... B63B 27/10
12,083,564 B2 * 9/2024 Gray ..... A01D 44/00
12,116,290 B2 * 10/2024 Turner ..... B03D 1/1462
12,221,194 B2 * 2/2025 Lee ..... E02B 15/104
12,241,216 B2 * 3/2025 Covington ..... E02B 15/0864
12,263,922 B2 * 4/2025 Campbell ..... C02F 1/40
12,275,167 B1 * 4/2025 Cook ..... B02C 21/026
12,332,354 B2 * 6/2025 Dokken ..... G01S 19/14
12,392,157 B1 * 8/2025 Yang ..... C02F 1/001
12,435,480 B2 * 10/2025 Campbell ..... B63B 25/00
12,448,802 B1 * 10/2025 Zhong ..... E04H 4/1654
2002/0133983 A1 * 9/2002 Chesner ..... B01D 63/02 37/307
2003/0132154 A1 * 7/2003 Morin ..... B63B 35/32 210/242.1
2005/0223965 A1 * 10/2005 Austevoll ..... B63B 27/36 114/365
2006/0060513 A1 * 3/2006 Craig ..... E04H 4/1263 210/167.2
2006/0065586 A1 * 3/2006 Walczyk ..... E02B 15/048 210/242.1
2006/0096905 A1 * 5/2006 Burgassi ..... E04H 4/1263 210/242.1
2006/0102532 A1 * 5/2006 Cadotte, Jr. ..... B01D 21/0027 210/94
2006/0144774 A1 * 7/2006 Joliet ..... B63B 35/32 210/242.1
2007/0158253 A1 * 7/2007 Kellett ..... E02B 15/104 210/776
2009/0057217 A1 * 3/2009 Bartha ..... C02F 1/681 210/923
2010/0147781 A1 * 6/2010 Newman ..... A01G 33/00 210/776
2010/0186647 A1 * 7/2010 Lewis ..... C02F 1/40 62/320
2014/0021113 A1 * 1/2014 Caraballo Benitez ..... E02B 15/105 210/170.11
2014/0165894 A1 * 6/2014 Gastaldi ..... B63B 35/32 114/61.27
2014/0197088 A1 * 7/2014 Greve ..... E02B 15/104 210/242.1
2014/0231326 A1 * 8/2014 Biley ..... E02B 15/10 210/170.01
2014/0270972 A1 * 9/2014 Siewert ..... B63B 71/00 405/195.1
2014/0291254 A1 * 10/2014 Frame ..... E02B 15/00 210/241
2014/0367342 A1 * 12/2014 Horton ..... E02B 15/046 210/747.6
2015/0034565 A1 * 2/2015 Vaz Viegas ..... B63B 35/32 210/241
2015/0090646 A1 * 4/2015 Sebo ..... B63B 35/32 210/141
2015/0307162 A1 * 10/2015 Hawks ..... B63B 35/32 210/96.1
2016/0010300 A1 * 1/2016 Pizzi ..... E02B 15/104 210/396
2016/0017561 A1 * 1/2016 Lindholm ..... B63B 35/32 210/241
2016/0023718 A1 * 1/2016 Siewert ..... B63B 71/00 29/403.1

(56) References Cited

U.S. PATENT DOCUMENTS

2016/0023724 A1* 1/2016 Menard ..... B63B 1/125 114/61.1
2016/0185618 A1* 6/2016 De Luca ..... C02F 1/02 210/747.6
2016/0326035 A1* 11/2016 Heuser ..... C02F 1/682
2017/0051467 A1* 2/2017 Casadio ..... E04H 4/1263
2017/0297671 A1* 10/2017 LaMora, Jr. ..... B63B 35/32
2018/0238009 A1* 8/2018 Casadio ..... E04H 4/1654
2019/0009867 A1* 1/2019 Dieters ..... B63B 25/004
2020/0002208 A1* 1/2020 Edgell, II ..... B01D 36/04
2020/0086955 A1* 3/2020 Carlési ..... E02B 15/101
2020/0180737 A1* 6/2020 Menard ..... E02B 15/046
2021/0107608 A1* 4/2021 Spencer ..... B63H 11/00
2021/0139113 A1* 5/2021 Aguilera ..... B63B 35/32
2021/0214055 A1* 7/2021 Maydanik ..... E02B 15/046
2021/0276672 A1* 9/2021 Lin ..... B63B 35/32
2021/0292010 A1* 9/2021 Marin ..... B64G 1/66
2022/0024551 A1* 1/2022 Lordi ..... B63B 35/32
2022/0041256 A1* 2/2022 Svorcan ..... E02B 15/105
2022/0055720 A1* 2/2022 Dakhil ..... B63H 21/17
2022/0080480 A1* 3/2022 Gray ..... A01D 44/00
2022/0177082 A1* 6/2022 Na ..... B63B 35/32
2022/0274852 A1* 9/2022 Turner ..... B03D 1/1431
2022/0275594 A1* 9/2022 Cui ..... E02B 15/10
2022/0307215 A1* 9/2022 Shibayama ..... B63B 35/32
2022/0363353 A1* 11/2022 Campbell ..... E02B 15/0842
2023/0065821 A1* 3/2023 Marshall ..... E02B 15/048
2023/0067954 A1* 3/2023 Marshall ..... B63B 35/32
2023/0082558 A1* 3/2023 Gray ..... E02B 15/10 56/8
2023/0202622 A1* 6/2023 Lee ..... B63B 35/44
2023/0202623 A1* 6/2023 Hyde ..... B63G 8/39 114/256
2023/0249787 A1* 8/2023 Spencer ..... G05D 1/0038 114/31
2023/0399806 A1* 12/2023 Campbell ..... E02B 15/104
2024/0083556 A1* 3/2024 Wu ..... B63B 79/40
2025/0115337 A1* 4/2025 Garver ..... B63B 35/32
2025/0236364 A1* 7/2025 Basile ..... B63B 35/32

OTHER PUBLICATIONS https://theoceancleanup.com/rivers/, "Tackling Trash in Rivers" The Ocean Cleanup, accessed Oct. 3, 2023.

https://theoceancleanup.com/rivers/interceptor-original/, How it Works The Interceptor Original, accessed Oct. 3, 2023.

https://www.elastec.com/trash-skimmer-boat/, Trash Skimmer Boat, Elastec Omni Catamaran, accessed Oct. 3, 2023.

https://www.macaubusiness.com/azure-fighter-the-floating-vacuum-cleaner-tidying-up-taiwans-harbours/, "Azure fighter ": the floating vacuum cleaner tidying up Taiwan's harbours, 2019, accessed Oct. 3, 2023.

https://www.clearbluesea.org/fred/, Meet Fred, Clear Blue Sea 2023, accessed Oct. 3, 2023.

https://www.fastcompany.com/3028391/james-dyson-is-designing-a-giant-vacuum-on-a-boat-to-clean-ocean-trash, "James Dyson Is Designing A Giant Vacuum-On-A-Boat To Clean Ocean Trash", Fast Company & Inc @ 2023 Mansueto Ventures, LLC, accessed Oct. 3, 2023.

* cited by examiner

WATERBORNE WASTE-DISPOSAL VESSEL

BACKGROUND

The present disclosure relates to waste collection, and more particularly, to a waterborne waste-disposal vessel suitable for use in shallow areas of a body of water. The accumulation of trash in bodies of water, such as lakes, rivers, and canals, is a growing environmental concern. Trash, including plastic bags, bottles, and other debris, not only detracts from the appearance of these bodies of water, but also poses a significant threat to marine life and ecosystems.

Various approaches have been proposed to address the problem of waterborne trash, including manual removal, booms, and skimmers. However, these approaches can be time-consuming, expensive, and often only effective for larger debris. In recent years, there has been a growing interest in the development of waterborne vessels for trash collection. However, most of these vessels are designed for use in deep water and are not well suited for use in shallow bodies of water, where trash tends to accumulate.

Another challenge in the development of waterborne vessels for trash collection is the efficient removal and disposal of collected debris. Many existing vessels require manual removal of a waste container from the vessel, which can be labor-intensive and time-consuming. This not only reduces the efficiency of the trash collection process but also increases the risk of potential harm to marine life and ecosystems during the removal process.

There remains a need for a waterborne vessel that can efficiently pick up and dispose of trash in shallow bodies of water. The present invention addresses this need by providing a waterborne vessel with a unique system that is specifically designed for use in shallow water environments. This system is highly effective at collecting small and large debris alike, without the need for expensive or time-consuming manual labor.

SUMMARY

A waterborne vessel with a unique system designed for efficient and effective waste collection in shallow bodies of water is disclosed herein. The vessel's system may include a vacuum system that is effective at collecting small and large debris alike, without the need for excessive manual labor. A vacuum may be disposed above the water (rather than below or in-line with the surface of the water) in order to minimize the amount of water drawn into the vacuum when trash is collected. A container aboard the vessel may collect the trash and may be removed via an electric winch, eliminating the need for manual removal and ensuring that collected debris is quickly and safely removed from the vessel. Overall, the present invention offers a cost-effective and efficient solution to address the growing environmental concern of waterborne trash accumulation in shallow bodies of water.

In an embodiment, a waterborne vessel may include a removable container disposed upon a top surface of a body of the waterborne vessel. The waterborne vessel may further include two or more wheels coupled to the removable container. The waterborne vessel may further include one or more guiderails substantially beneath the removable container, wherein the one or more guiderails are operable to direct a movement of the two or more wheels. The waterborne vessel may further include at least one winch coupled to the container via one or more of a rope, a cable, and a chain, wherein the at least one winch is operable to pull the container generally along the one or more guiderails. The waterborne vessel may further include a vacuum comprising a fan, wherein actuation of the fan causes one or more objects to be drawn substantially upward into the vacuum, and wherein the one or more objects are delivered to the removable container.

In certain embodiments, the waterborne vessel may include an actuatable arm coupled to the vacuum, and the actuatable arm may be operable to control a position of at least a portion of the vacuum. In certain embodiments, the actuatable arm may include one or more of a hydraulic arm, a hydroelectric arm, and a pneumatic arm.

In certain embodiments, the waterborne vessel may include a boat ramp, wherein at least a portion of the boat ramp is disposed beneath at least a portion of the waterborne vessel. In certain embodiments, the waterborne vessel may include a trailer disposed upon the boat ramp, wherein the trailer is operable to support the weight of the removable container.

In certain embodiments, the removable container may include at least one mesh drain way, and the at least one mesh drain way may be operable to remove a fluid from the removable container without removing at least one of the one or more objects.

In certain embodiments, the waterborne vessel may include an operator's platform disposed upon the top surface of the body of the waterborne vessel, and the operator's platform may be raised to a sufficient height such that the container may roll under the operator's platform.

In certain embodiments, the container may be positioned substantially between the operator's platform and the at least one winch.

In certain embodiments, the waterborne vessel may include an engine mount coupled to the body of the waterborne vessel. In certain embodiments, the waterborne vessel may include a propeller coupled to the engine mount, and the propeller may be operable to drive motion of the waterborne vessel through a fluid. In certain embodiments, the engine mount may be operable to alter a vertical position of the propeller such that the propeller may be raised when a depth of the fluid is low and lowered when the depth of the fluid is high.

A waste disposal system may include a container disposed upon a top surface of a body of the waste disposal system. The waste disposal system may further include a vacuum. The vacuum may include a fan, and actuation of the fan may cause one or more objects to be drawn into the vacuum. The one or more objects may be delivered to the container. The waste disposal system may further include an actuatable arm coupled to the vacuum, and the actuatable arm may be operable to control a position of at least a portion of the vacuum.

In certain embodiments, the container may include at least one mesh drain way, and the at least one mesh drain way may be operable to remove a fluid from the container without removing at least one of the one or more objects.

In certain embodiments, the actuatable arm may be a hydraulic arm.

In certain embodiments, the waste disposal system may further include an engine mount coupled to the body of the waste disposal system. In certain embodiments, the waste disposal system may further include a propeller coupled to the engine mount, and the propeller may be operable to drive motion of the waste disposal system through a fluid. In certain embodiments, the engine mount may be operable to alter a vertical position of the propeller such that the propeller may be raised when a depth of the fluid is low and lowered when the depth of the fluid is high.

In certain embodiments, the fan of the vacuum may be disposed upon a back portion of the waste disposal system, and the portion of the vacuum controlled by the actuatable arm may be disposed generally in front of the waste disposal system.

In certain embodiments, the discharge shoot may include one or more partial baffles operable to uniformly disperse the one or more objects upon delivery to the container, and the vacuum may draw the one or more objects substantially upward into the vacuum.

A method may include controlling a waterborne vessel such that the waterborne vessel moves to a location having one or more objects. The method may further include actuating a vacuum to draw the one or more objects into the vacuum. The method may further include delivering the one or more objects into a container. The method may further include removing the container from the waterborne vessel via a winch.

In certain embodiments, the method may further include actuating a hydraulic arm to control a position of at least a portion of the vacuum.

In certain embodiments, the hydraulic arm may be actuated such that the portion of the vacuum is disposed above land, and the one or more objects may be drawn from the land into the vacuum.

In certain embodiments, the container may be removed by actuating a winch, and actuation of the winch may cause two or more wheels of the container to be directed by one or more guiderails from a surface of the waterborne vessel to a surface of a trailer. In certain embodiments, the trailer may be positioned upon a boat ramp.

In certain embodiments, the method may further include determining that a depth of water is low. In certain embodiments, in response to determining that the depth of water is low, an engine mount may be actuated to raise a position of a propeller.

In certain embodiments, the one or more objects may be drawn from generally in front of the waterborne vessel to generally above the waterborne vessel.

In certain embodiments, the method may further include using one or more partial baffles to uniformly disperse the one or more objects upon delivery to the container.

BRIEF DESCRIPTION OF THE DRAWINGS

For a more complete understanding of the present disclosure and its features and advantages, reference is now made to the following description, taken in conjunction with the accompanying drawings, in which.

Figure 1:
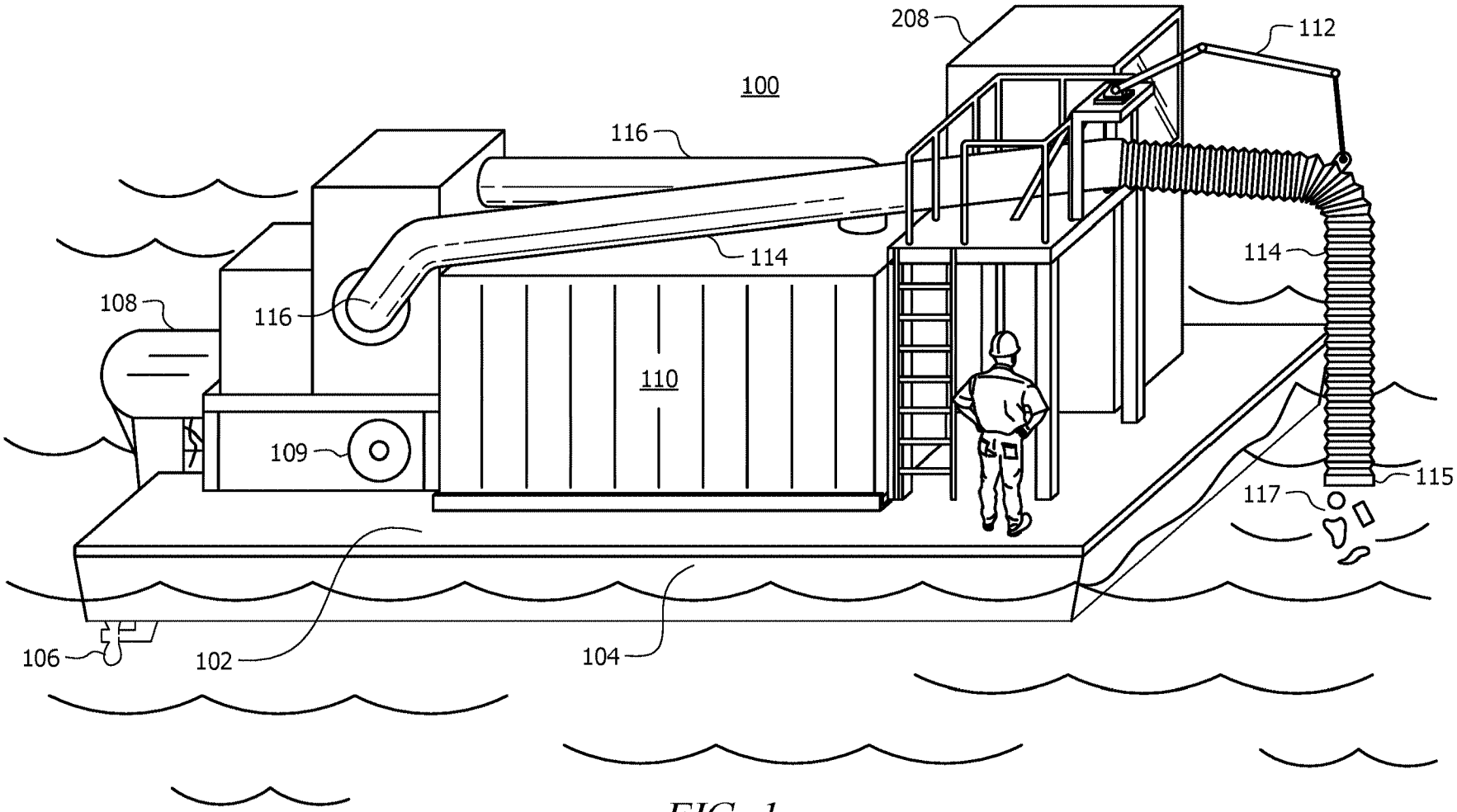
FIG. 1 is a perspective view of a waterborne waste-disposal vessel, according to one or more embodiments.

These and other features and characteristics of gas pretreatment systems and methods will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular forms of "a", "an", and "the" include plural referents unless the context clearly dictates otherwise.

DETAILED DESCRIPTION

For purposes of the description hereinafter, it is to be understood that the disclosure may assume alternative variations and step sequences, except where expressly specified to the contrary. It is also to be understood that the specific devices and processes illustrated in the attached drawings and described in the following specification are simply exemplary aspects of the disclosure. Hence, specific dimensions and other physical characteristics related to the aspects disclosed herein are not to be considered as limiting.

As used herein, the term "coupled" should be understood to include any direct or indirect connection between two things, including, and without limitation, a physical connection (including, and without limitation, a wired or mechanical connection), a non-physical connection (including, and without limitation, a wireless connection), a fluid connection (including, and without limitation, a connection allowing for fluid communication), or any combination thereof. Furthermore, the words "comprising" (and any form of comprising, such as "comprise" and "comprises"), "having" (and any form of having, such as "has" and "have"), "including" (and any form of including, such as "includes" and "include") or "containing" (and any form of containing, such as "contains" and "contain") are to be understood as inclusive and open-ended and do not exclude additional, unrecited elements or method steps.

As used herein, the term "at least one of" is synonymous with "one or more of." For example, the phrase "at least one of A, B, and C" means any one of A, B, and C, or any combination of any two or more of A, B, and C. For example, "at least one of A, B, and C" includes one or more of A alone; or one or more of B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of." For example, the phrase "at least two of D, E, and F" means any combination of any two or more of D, E, and F. For example, "at least two of D, E, and F" includes one or more of D and one or more of E; or one or more of D and one or more of F; or one or more of E and one or more of F; or one or more of all of D, E, and F.

FIG. 1 is a perspective view of a waterborne vessel 100, according to one or more embodiments. The waterborne vessel 100 may include a body 104 operable to float upon a fluid, for example, a body of water. A winch 109 may be coupled to a container 110 via one or more of a rope, a cable, and a chain. Both the winch 109 and the container 110 may be positioned atop a top surface 102 of the body 104 of the waterborne vessel 100. An engine mount 108 may be positioned substantially atop the top surface 102 of the body 104 of the waterborne vessel 100. The engine mount may include a shaft (not shown) coupled to a propeller 106, and the propeller may be operable to push the waterborne vessel 100 through the fluid. A vacuum 114 may be positioned such that at least a portion of the vacuum 114 is above the fluid and above the top surface 102 of the body 104 of the waterborne vessel 100. The vacuum 114 may be coupled to a discharge shoot 116, and the discharge shoot 116 may deposit one or more items in the container 110. The vacuum 114 may be further coupled to an actuatable arm 112. The actuatable arm may be communicatively coupled to a controller (not shown), and the controller may be within reach of an operator's platform 208. In certain embodiments, the container 110 may be positioned substantially between the operator's platform 208 and the winch 109.

In certain embodiments, the operator's platform 208 may be positioned at a height sufficient such that the container 110 may be moved underneath the operator's platform 208. Winch 109 may be actuated to enable movement of the container 110 under the operator's platform 208.

An operator may stand upon the operator's platform 208. The operator may be able to control the actuatable arm 112 via the controller. By motion of the actuatable arm 112, the vacuum 114 may be moved to different locations above the fluid. The actuatable arm 112 may be any suitable actuatable arm; for example, and without limitation, the actuatable arm may be a hydraulic arm, a hydroelectric arm, or a pneumatic arm. Throughout its movement, the vacuum 114 may remain positioned such that an opening 115 of the vacuum 114 is above the fluid. The vacuum may include one or more fans, and the one or more fans may include one or more impellers. As the impellers turn, one or more objects 117 may be drawn from the fluid into the vacuum 114. Turning of the one or more impellers may be initiated and stopped by an operator upon the operator's platform 208. By positioning the vacuum 114 above the fluid, the one or more objects 117 may be drawn into the vacuum 114 while simultaneously drawing a minimum amount of fluid into the vacuum 114. Once drawn into the vacuum 114, the one or more objects 117 may move through the base of the discharge shoot 116 and into the container 110. In certain embodiments, the vacuum 114 may initiate suction from the base of the discharge shoot 116.

In certain embodiments, the opening 115 of the vacuum 114 may be positioned in front of the waterborne vessel 100. In certain other embodiments, the opening 115 of the vacuum 114 may be positioned to the side of the waterborne vessel 100. In still other embodiments, the opening 115 of the vacuum 114 may be positioned behind the waterborne vessel 100. In certain embodiments, the vacuum 114 and actuatable arm 112 may be sufficiently mobile such an operator may move the opening 115 of the vacuum 114 from any first edge of a boat to any second edge of the boat. In certain embodiments, the operator may be limited as to which edge(s) of the boat at which the opening 115 of the vacuum 114 may reside.

By moving the opening 115 of the vacuum 114 further from the surface of the fluid (noting that the opening 115 of the vacuum 114 is always positioned above the surface of the fluid), a wider area may be affected by the pull of the vacuum 114. Conversely, by moving the opening 115 of the vacuum 114 closer to the surface of the fluid, a smaller area may be affected by the pull of the vacuum 114.

In certain embodiments, an extender (not shown) may be attachable to the opening 115 of the vacuum 114. The extender may be operable to increase the total length of the vacuum 114. By extending the total length of the vacuum 114, the waterborne vessel 100 may more easily be able to collect waste from land surrounding the fluid. In certain embodiments, the opening 115 of the vacuum 114 and the extender may be connectable by a designed interface. In certain other embodiments, an extender may be attached to the opening 115 of the vacuum 114 via an adhesive.

In certain embodiments, the one or more objects 117 may be delivered to the container 110 by dropping them from one or more openings in the vacuum 114 and/or discharge shoot 116 into the container 110. The discharge shoot 116 may include one or more partial baffles to uniformly disperse the one or more objects 117 into the container 110.

In certain embodiments, the engine mount 108 may be operable to raise or lower the propeller 106 based at least in part on the depth of the fluid. For example, and without limitation, the engine mount 108 may be operable to raise the propeller a specified distance, such as one inch, two inches, three inches, four inches, six inches, eight inches, ten inches, twelve inches, fourteen inches, sixteen inches, eighteen inches, twenty inches, twenty-four inches, twenty-eight inches, thirty inches, thirty-two inches, or thirty-six inches. In certain embodiments, the engine mount 108 may only be able to oscillate between two states: a fully raised states and a fully lowered state. In certain other embodiments, the engine mount 108 may be operable to raise or lower the propeller 106 to any location within its range of motion.

In certain embodiments, the waterborne vessel 100 may comprise one or more sensors (not shown). The one or more sensors may be operable to communicate a depth of the fluid to one or more of an operator (for example, via a screen) and an automated controller (not shown). An operator (for example, an operator on the operator's platform 208) may observe a depth of the fluid with or without the aid of the one or more sensors. In response to observing a low depth of fluid, the operator may raise the propeller 106 to avoid damage to the propeller 106 from contacting one or more solid objects. In response to observing a high depth of fluid, the operator may lower the propeller 106. Alternatively, or in addition, a controller may be operable to automatically raise or lower the propeller 106 in response to depth readings from the sensors.

The propeller 106 may include a cavitation plate. The cavitation plate may be flush with the bottom of the body 104 of the waterborne vessel 110.

Any suitable engine may be used without departing from the scope of the present disclosure, and it is within the ability of one skilled in the art and having the benefit of the present disclosure to select a suitable engine. In certain embodiments, a dual engine may be used to achieve optimal maneuverability. By way of example of the flexibility of design permitted within the present disclosure (and not by way of limitation), a repurposed V-8 MerCruiser Diesel Engine with an outdrive propulsion system may be used with the waterborne vessel 100 without departing from the scope of the present disclosure.

Figure 2:
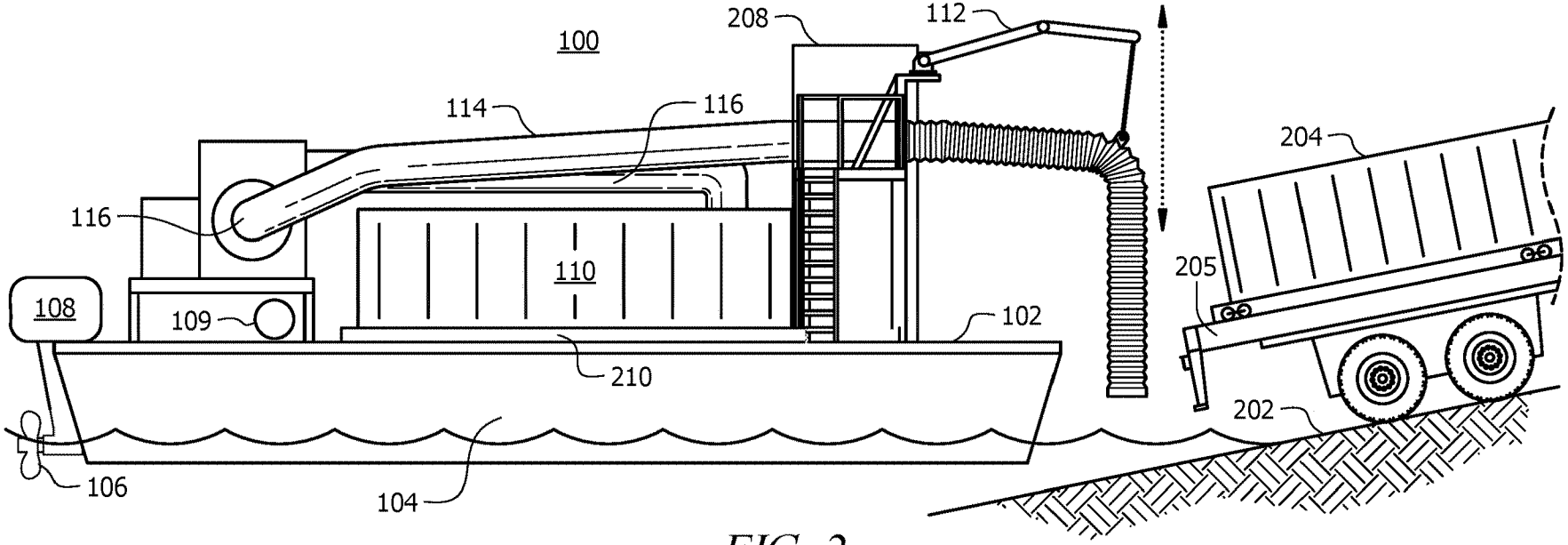
FIG. 2 is a side view of a waterborne waste-disposal vessel, according to one or more embodiments.

FIG. 2 is a side view of a waterborne vessel 100, according to one or more embodiments. As described above, waterborne vessel 100 may include a body 104, and the body 104 may include a top surface 102. A container 110 may be positioned atop a guiderail system 210, which may be positioned atop the top surface 102. The waterborne vessel 100 may include a propeller 106 coupled to an engine mount 108. The waterborne vessel 100 may further include a vacuum 114, and the vacuum 114 may include a discharge shoot 116 connecting the vacuum 114 to the waterborne vessel 100. An operator's platform 208 may be positioned beside a portion of the vacuum 114, and the vacuum 114 may be coupled to an actuatable arm 112. In certain embodiments, an operator may control the waterborne vessel 100 such that it approaches a boat ramp 202. A trailer 205 may be positioned atop the boat ramp 202, and a second container 204 may be positioned atop the trailer. The trailer 205 may be operable to support the weight of the second container 204 and/or the container 110, including any content within the container(s).

In certain embodiments, a first winch 109 may be positioned atop the waterborne vessel 100. In certain embodiments, a second winch (not shown) may be positioned atop the trailer 205. In certain embodiments, one or more of the first winch and the second winch may be an electric winch. In embodiments using an electric winch, the electric winch may be designed to operate at any suitable voltage; for example, and without limitation, a 12-volt winch may be used. When there is no container atop the trailer, one or more of the first winch 109 and the second winch may be operable to assist in moving the container 110 from the waterborne vessel 100 to the trailer 205. When there is no container 110 atop the waterborne vessel, one or more of the first winch 109 and the second winch may be operable to assist in moving a second container 204 from atop the trailer 205 to the waterborne vessel 100. Once a container 110 is removed from the waterborne vessel 100, the container 110 may be emptied and an empty second container 204 may replace the container 110 atop the waterborne vessel 100. In certain embodiments, container 110 and second container 204 may be the same container, such that a single container is cycled on and off the waterborne vessel 100. In an alternative embodiment, a crane (not shown) may be operable to move the container 110 off of the waterborne vessel 100 and may be further operable to move the second container 204 onto the waterborne vessel 100.

Figure 3:
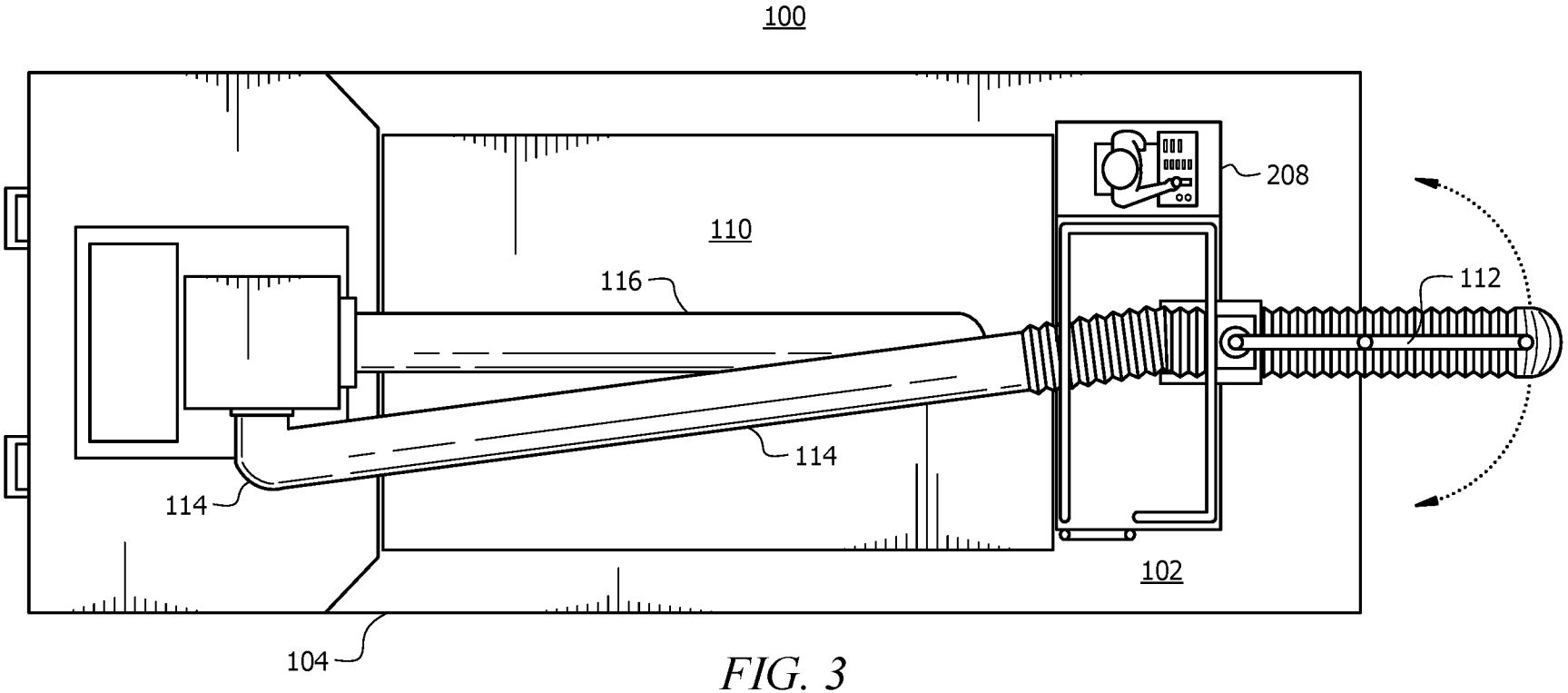
FIG. 3 is a top view of a waterborne waste-disposal vessel, according to one or more embodiments.

FIG. 3 is a top view of a waterborne vessel 100, according to one or more embodiments. As described above, waterborne vessel 100 may include a top surface 102 of a body 104. A container 110 may be positioned atop the top surface 102 of the body 104 of the waterborne vessel 100. In certain embodiments, an operator's platform 208 may be positioned at a sufficient height such that the container 110 may be able to pass under the operator's platform 208. In certain embodiments, a vacuum 114 comprising a discharge shoot 116 may be positioned above the container 110.

In certain embodiments, the waterborne vessel 100 may include a skid plate hull across the lowest point of the bow of the waterborne vessel 100. The skid plate hull may be any suitable thickness—for example, and without limitation, the skid plate hull may be one-quarter of an inch thick or three-sixteenths of an inch thick. Furthermore, the skid plate hull may be made of any suitable material—for example, and without limitation, the skid plate hull may be made partially or entirely of steel. In addition to the skid plate hull, one or more skid runners may be attached to the waterborne vessel 100 to protect the waterborne vessel 100 from damage. The skid runners may be made of any suitable material—for example, and without limitation, the skid runners may be made partially or entirely of steel. The skid runners may be any suitable thickness—for example, and without limitation, the skid runners may be three-quarters of an inch thick. When the skid runners wear down, they may be repaired or replaced.

Certain aspects disclosed herein are especially well-suited to environments wherein the depth of the fluid is low. For example, and without limitation, one or more of the following aspects may allow a system to operate safely and effectively in a shallow fluid: (1) allowing the propeller 106 to be raised and lowered; (2) positioning an opening 115 of the vacuum 114 above the surface of the fluid rather than in-line with or beneath the surface of the fluid; (3) including a protective skid plate hull and/or one or more side runners; and (4) designing a system to collect the one or more objects 117 via a vacuum 114 rather than via a conveyor belt. This operability is especially important to the context of waste removal from a body of water because it is common for a high percentage of waste to accumulate near shores and in shallow areas.

Figure 4:
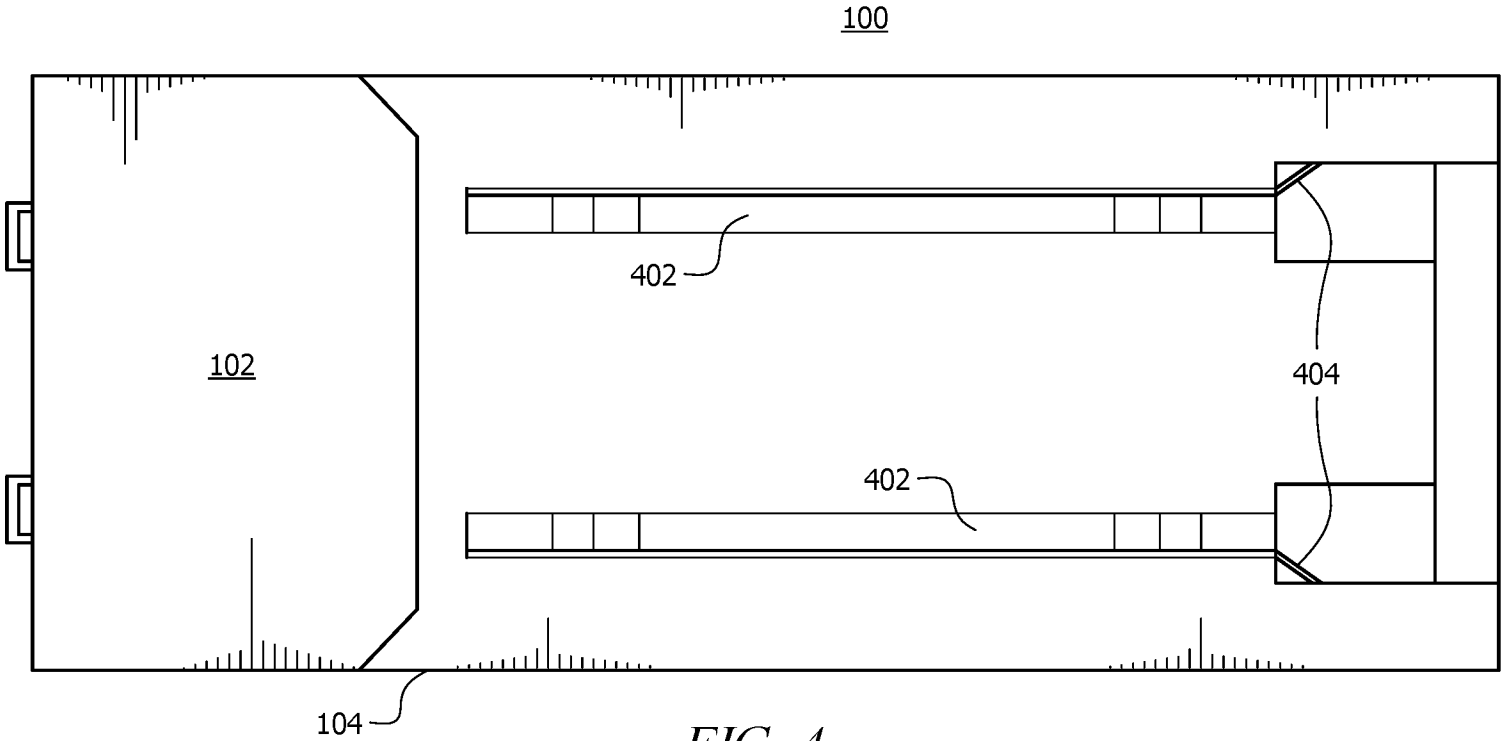
FIG. 4 is a top view of a waterborne waste-disposal vessel's guiderail system, according to one or more embodiments.

FIG. 4 is a top view of a waterborne vessel's guiderail system, according to one or more embodiments. The top surface 102 of the body 104 of the waterborne vessel 100 may include one or more guiderails 402. The guiderails 402 may be operable to control a direction of motion of a container 110 atop the waterborne vessel when one or more winches (e.g., winch 109) are actuated. In certain embodiments, outer guides 404 may be positioned at approximately a forty-five-degree angle to guide the container 110 onto the guiderails 402. In certain embodiments, the winch 109 may be operable to pull the container generally along the guiderails 402.

In certain embodiments, mesh drain ways may be included in the container 110 to free the container 110 of excess fluid picked up by the vacuum 114 without removing the one or more objects 117. Furthermore, in certain embodiments, a fluid deflector (not shown) may be included behind the trash container to direct fluid from the container 110 overboard.

The container 110 may include two or more wheels. Furthermore, the container 110 may use any suitable size of wheels; for example, and without limitation, eight-inch wheels may be used. The wheels of the container 110 may comprise any suitable material, including, and without limitation, steel. In an embodiment, the container 110 may be approximately five feet and seven inches tall, and the operator's platform 208 may be raised to a height of six feet and four inches; thus, the container 110 may roll under the operator's platform 208. The measurements provided herein are provided as examples and are not intended to limit the scope of the disclosure.

The systems and methods disclosed herein may be practiced with any suitable size of waterborne vessel 100. For example, in certain embodiments, the waterborne vessel 100 may be approximately 20 feet long, 24 feet long, 36 feet long, 48 feet long, or 60 feet long. In certain embodiments, the waterborne vessel 100 may be approximately 6 feet wide, 12 feet wide, 16 feet wide, 20 feet wide, or 25 feet wide. In certain embodiments, the ratio of length-to-width of the waterborne vessel 100 may be approximately 2:1, 3:1, or 4:1. Other dimensions may be used without departing from the scope of the present disclosure.

Similarly, the container 110 may be any suitable size. For example, and without limitation the volume of the container 110 may be 275 cubic feet, 400 cubic feet, 600 cubic feet, 800 cubic feet, or 1000 cubic feet. Other dimensions may be used without departing from the scope of the present disclosure.

In an embodiment, the container 110 may include a screen (not shown) across the top of the container 110. Because the discharge shoot 116 creates air currents capable of blowing one or more objects 117 out of the container 110, the screen may be operable to allow air flow while trapping one or more objects 117 in the container. In an alternative embodiment, a breathable tarp may serve substantially the same function as the screen discussed above.

Those skilled in the art will understand that FIGS. 1-4 depict illustrative examples of a system that may be used in accordance with the present disclosure; they are in no way limiting. Certain elements may be added or removed from the system without departing from the scope of the present disclosure. Furthermore, the positions of one or more elements may be altered without departing from the scope of the present disclosure. It is within the ability of one skilled in the art having the benefit of the present disclosure to add to, remove from, and/or rearrange the elements disclosed herein.

Figure 5:
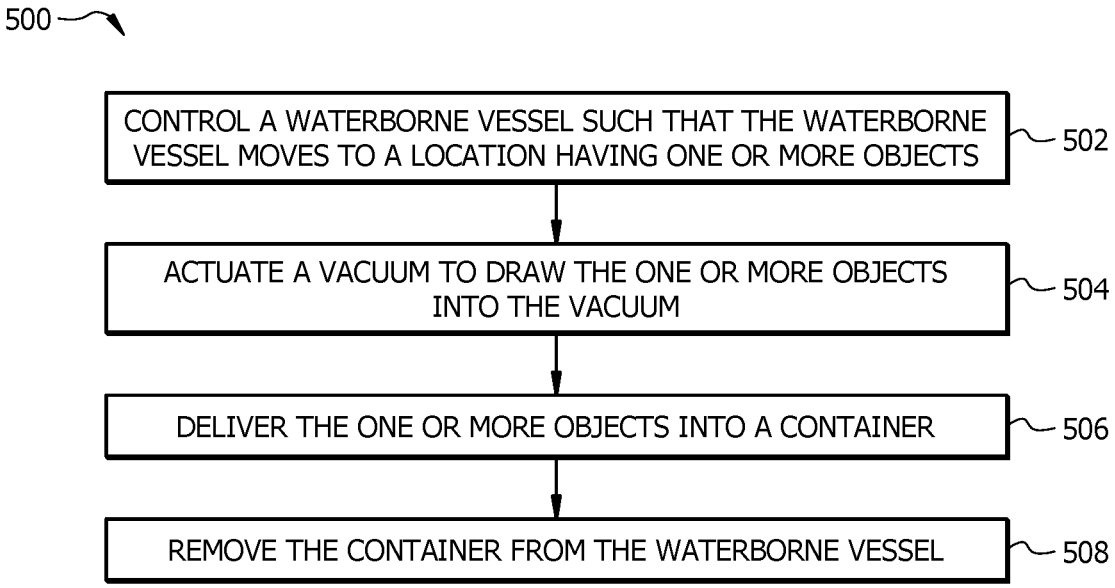
FIG. 5 is a process diagram depicting a method of waste disposal, according to one or more embodiments.

FIG. 5 is a process diagram depicting a method of waste disposal 500, according to one or more embodiments. The first step 502 of the method of waste disposal 500 may be to control a waterborne vessel 100 such that the waterborne vessel 100 moves to a location having one or more objects 117. The second step 504 may be to actuate a vacuum 114 to draw the one or more objects 117 into the vacuum 114. The third step 506 may be to deliver the one or more objects 117 into a container 110. The fourth step 508 may be to remove the container 110 from the waterborne vessel 100.

Those skilled in the art will understand that FIG. 5 depicts an illustrative example of a method that may be practiced in accordance with the present disclosure; it is in no way limiting. Certain method steps may be added or removed without departing from the scope of the present disclosure. Furthermore, the order of steps may be partially or entirely rearranged without departing from the scope of the present disclosure. It is within the ability of one skilled in the art having the benefit of the present disclosure to add to, remove from, and/or rearrange the method steps disclosed herein.

What is claimed is:

1. A waterborne vessel, comprising:

a removable container disposed upon a top surface of a body of the waterborne vessel;

two or more wheels coupled to the removable container;

one or more guiderails substantially beneath the removable container, wherein the one or more guiderails are operable to direct a movement of the two or more wheels;

at least one winch coupled to the container via one or more of a rope, a cable, and a chain, wherein the at least one winch is operable to pull the container generally along the one or more guiderails; and a vacuum comprising a fan, wherein actuation of the fan causes one or more objects to be drawn substantially upward into the vacuum, and wherein the one or more objects are delivered to the removable container.

2. The waterborne vessel of claim 1, further comprising an actuatable arm coupled to the vacuum, wherein the actuatable arm is operable to control a position of at least a portion of the vacuum, and wherein the actuatable arm comprises one or more of a hydraulic arm, a hydroelectric arm, and a pneumatic arm.

3. The waterborne vessel of claim 1, further comprising:

a boat ramp, wherein at least a portion of the boat ramp is disposed beneath at least a portion of the waterborne vessel; and a trailer disposed upon the boat ramp, wherein the trailer is operable to support the weight of the removable container.

4. The waterborne vessel of claim 1, wherein the removable container comprises at least one mesh drain way, and wherein the at least one mesh drain way is operable to remove a fluid from the removable container without removing at least one of the one or more objects.

5. The waterborne vessel of claim 1, further comprising an operator's platform disposed upon the top surface of the body of the waterborne vessel, wherein the operator's platform is raised to a sufficient height such that the container may roll under the operator's platform.

6. The waterborne vessel of claim 5, wherein the container is substantially between the operator's platform and the at least one winch.

7. The waterborne vessel of claim 1, further comprising:

an engine mount coupled to the body of the waterborne vessel; and a propeller coupled to the engine mount, wherein the propeller is operable to drive motion of the waterborne vessel through a fluid, and wherein the engine mount is operable to alter a vertical position of the propeller such that the propeller may be raised when a depth of the fluid is low and lowered when the depth of the fluid is high.

* * * * *